United States Patent [19]

Yamada

[11] Patent Number: 4,912,819

[45] Date of Patent: Apr. 3, 1990

[54] HOOK ELEMENT FOR SURFACE FASTENERS

[75] Inventor: Yasuo Yamada, Kurobe, Japan

[73] Assignee: Yoshida Kogyo K. K., Tokyo, Japan

[21] Appl. No.: 270,438

[22] Filed: Nov. 8, 1988

Related U.S. Application Data

[63] Continuation of Ser. No. 126,253, Nov. 25, 1987, abandoned.

[30] Foreign Application Priority Data

Nov. 26, 1986 [JP] Japan ..... 61-180554[U]
Mar. 16, 1987 [JP] Japan ..... 62-37219[U]

[51] Int. Cl.[4] ..... A44B 18/00
[52] U.S. Cl. ..... 24/442; 24/447
[58] Field of Search ..... 24/442, 445, 447, 395, 24/16 PB, 90 A; 264/78

[56] References Cited

U.S. PATENT DOCUMENTS

| | | | |
|---|---|---|---|
| 1,999,034 | 4/1935 | Clark | 24/90 A |
| 2,925,625 | 2/1960 | Souza | 264/78 |
| 3,066,366 | 12/1962 | Wyckoff et al. | 24/16 PB |
| 3,074,675 | 1/1963 | Brown | 24/16 PB |
| 3,101,517 | 8/1963 | Fox et al. | 24/442 |
| 3,312,583 | 4/1967 | Rochlis | 24/442 |
| 3,371,390 | 3/1968 | Sieglitz, Jr. | 24/16 PB |
| 3,447,207 | 6/1969 | Danzer | 24/16 PB |
| 3,762,000 | 10/1973 | Menzin et al. . | |
| 3,777,334 | 12/1973 | Countryman | 24/16 PB |
| 3,783,476 | 1/1974 | Frohlich | 24/395 |
| 3,913,183 | 10/1975 | Brumlik | 24/447 |
| 4,003,110 | 1/1977 | Bennett . | |
| 4,344,240 | 8/1982 | Schiller | 24/90 A |

FOREIGN PATENT DOCUMENTS

| | | | |
|---|---|---|---|
| 0053348 | 6/1982 | European Pat. Off. . | |
| 2318951 | 2/1977 | France . | |
| 2535585 | 5/1984 | France | 24/90 A |
| 3012431 | 10/1980 | Japan . | |
| 0295638 | 3/1954 | Switzerland | 24/445 |
| 1552655 | 9/1979 | United Kingdom . | |

*Primary Examiner*—Victor N. Sakran
*Attorney, Agent, or Firm*—Hill, Van Santen, Steadman & Simpson

[57] ABSTRACT

A hook or male element for surface fasteners has peripheral surface irregularities in the form of protuberances and/or grooves, affording increased surface area for a given material. This hook element is capable of holding itself in the shape and posture desired for effective engagement with its female counterpart, a loop element.

22 Claims, 3 Drawing Sheets

HOOK ELEMENT FOR SURFACE FASTENERS

This application is a continuation of application Ser. No. 07/126,253, filed Nov. 25, 1987, now abandoned.

BACKGROUND OF THE INVENTION

This application is related to my copending application, U.S. Ser. No. 125,177, now U.S. Pat. No. 4,811,468 filed on even date herewith).

1. Field of the Invention:

This invention relates generally to hook-and-loop or surface fasteners and particularly to hook elements therefor.

2. Description of the Prior Art:

Many hook-and-loop fasteners have been proposed in the art for use on a variety of articles such as sphygmomanometer bands, wrist watch bands, diapers, bags, clothings, sporting goods and the like. Conventional hook-and-loop fasteners comprise hooks or male elements on one support tape engageable with corresponding loops or female elements on the other tape, the hooks being plastic monofilaments having a round cross section and smooth or refined surface characteristics. Because of these physical characteristics, the starting monofilamentary material is relatively low in thermal efficiency and hence difficult to retain the shape of the hook afforded upon heat set, the resulting hooks being susceptible to elongation or deformation and hence insufficient in opportunity for, and strength of, coupling engagement with their mating loops. Such hook elements are further difficult to dye to sufficient depth and with uniformity.

SUMMARY OF THE INVENTION

With the foregoing drawbacks of the prior art in view, the present invention seeks to provide a hook or male element for surface fasteners which is capable of holding itself in the shape and posture desired for effective engagement with its female counterpart.

It is another object of the invention to provide a hook element for surface fasteners which can be effectively dyed.

It is a further object of the invention to provide a hook element for surface fasteners which can be produced with less quantities of a starting plastic material than heretofore required.

Briefly stated, the hook element of the invention is provided with peripheral surface irregularities in the form of grooves or protuberances, or a combination thereof, affording increased surface area for a given material.

These and other objects and features of the invention will be better understood from the following description taken in connection with the accompanying drawings which illustrate by way of example certain preferred embodiments of the invention.

DETAILED DESCRIPTION OF THE INVENTION

According to the principles of the invention, a hook or male element for a surface fastener is provided peripherally with a plurality of protuberances and/or grooves or notches.

Figure 1:
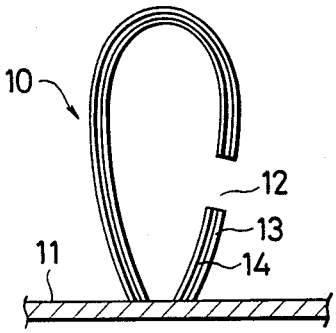
FIG. 1 is a elevational view on enlarged scale of a hook element secured to a support tape.
Figure 2A:
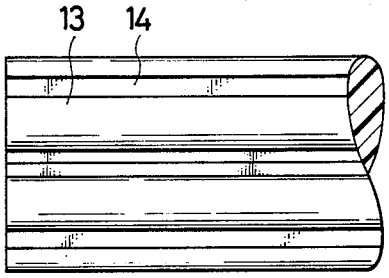
FIG. 2*a* is a plan view, partly sectional, on enlarged scale of a portion of a hook element according to one embodiment of the invention.
Figure 2B:
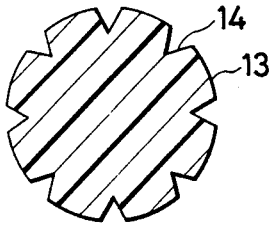
FIG. 2*b* is a cross-sectional view of FIG. 2*a;*

Referring to FIG. 1, there is shown a preferred form of a hook or male element 10 generally circular in cross section which is supported on a substrate such as a tape 11 and which has a slit 12 through which the hook 10 is engageable with its mating loop or female element (not shown) in a manner well known in the art. The hook element 10 of FIG. 1 is made of a suitable plastic filamentary material and has a plurality of longitudinally, radially extending protuberances 13 alternating with longitudinal grooves 14 as better shown in FIGS. 2*a* and 2*b*.

Figure 3A:
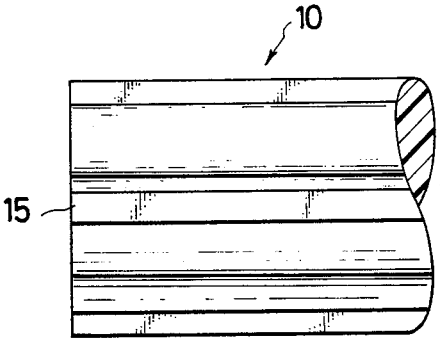
FIG. 3*a* is a plan view, partly sectional, on enlarged scale of a portion of a hook element according to another embodiment of the invention.
Figure 3B:
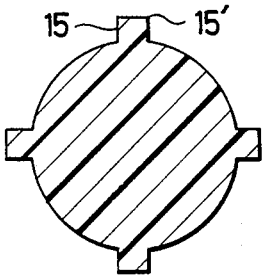
FIG. 3*b* is a cross-sectional view of FIG. 3*a;*

The hook element 10 shown in FIGS. 3*a* and 3*b* is characterized by the provision of four longitudinally extending, cross-sectionally square protuberances 15 which are equally spaced in symmetric positions with their corners 15' rounded off to prevent possible damage on the mating loop.

Figure 4A:
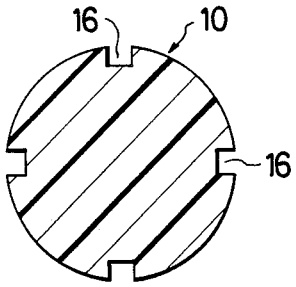
FIG. 4*a* is a cross-sectional view on enlarged scale of a hook element according to a further embodiment of the invention.

FIG. 4*a* shows a modification of FIGS. 3*a* and 3*b* in which the hook element 10 is provided with four grooves 16 in place of the protuberances 15.

Figure 4B:
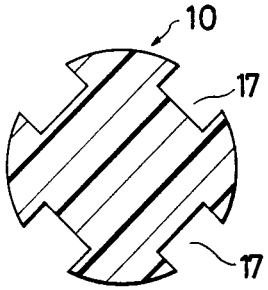
FIG. 4*b* is a cross-sectional view on enlarged scale of a hook element according to still another embodiment of the invention.

FIG. 4*b* shows a hook element 10 similar to that shown in FIG. 4*a* but having larger grooves 17.

Figure 4C:
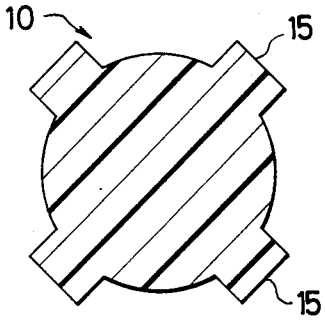
FIG. 4*c* is a cross-sectional view on enlarged scale of a hook element according to still further embodiment of the invention.

FIG. 4*c* shows a hook element 10 is the same as that of FIGS. 3 and 3*b* except for the protuberances 15 being dimensionally larger.

Figure 5A:
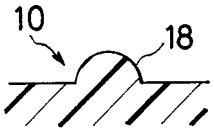
FIGS. 5*a* and 5*b*, FIGS. 6*a* and 6*b*, and FIG. 7*a* and 7*b* inclusive each are cross-sectional views on enlarged scale of a symmetrical set of modified grooves in and protuberances on hook elements according to the invention contemplated under the invention.
Figure 5B:
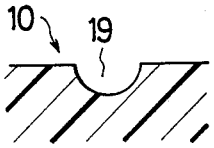

The hook element 10 shown in FIGS. 5*a* and 5*b* is provided with either cross-sectionally semicircular or arcuate protuberance or protuberances 18 or with cross-sectionally semicircular or arcuate grooves 19.

Figure 6A:
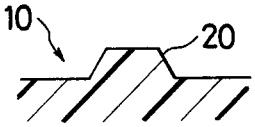
Figure 6B:
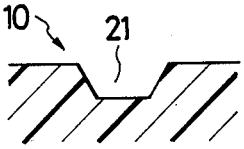

FIGS. 6*a* and 6*d* show a hook element 10 having protuberance 20 or a groove 21 cross-sectionally trapezoidal.

Figure 7A:
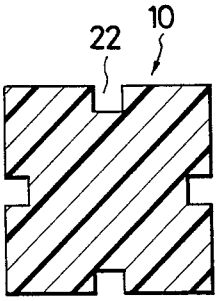
Figure 7B:
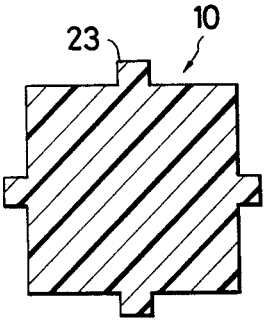

FIG. 7*a* shows a further modification of a hook element 10 which is generally square in cross section and which has a longitudinal, cross-sectionally square groove 22 in each of the four sides, and FIG. 7*b* has a hook element 10 symmetrical to that of FIG. 7*a* in that it has protuberances 23 in place of corresponding grooves 22.

Having thus described the invention, it will be understood that the hook element 10 for surface fastener is importantly and invariably provided with peripheral surface irregularities either in a convex (protuberance) form or a concave (groove) form, or a combination thereof, thereby providing a greater gross surface area than that of the conventional counterpart with the re-sult that the hook forming material with such surface characteristics can be more effectively thermally set in the desired form which is retainable over prolonged service life. The hook element 10 of the invention can be colored distinctly and uniformly when dyed for example by pad steaming as the protuberances or grooves afford increased surface tension and greater dye pick-up. Also advantageously, the hook elements 10 with protuberances alone can be fabricated with reduced amounts of thermoplastic monofilamentary material as the protuberances serve to provide increased resistance to bending stress.

What is claimed is:

1. A surface fastener comprising:

a substrate in the form of a tape;

a hook element supported on said substrate;

said hook element being made of a thermal plastic monofilamentary material, being thermally set in a hook form and having a peripheral surface configuration to enhance the thermal setting of the hook shape and to enhance the retention of said hook shape, said surface configuration comprising at least one of protrubences in grooves extending longitudinally throughout the length of said hook element, said hook element being dyed with a predetermined color and said surface configuration affording increased surface tension and greater dye pick-up.

2. A hook element for surface fasteners according to claim 1, having a plurality of equally spaced longitudinal protuberances or grooves.

3. A hook element for surface fasteners according to claim 1, having alternate radially extending protuberances and grooves.

4. A hook element for surface fasteners according to claim 1, wherein each of said protuberances has a semicircular cross section.

5. A hook element for surface fasteners according to claim 1, wherein each of said protuberances has a trapezoidal cross section.

6. A hook element for surface fasteners according to claim 1, wherein each of said grooves has a semicircular cross section.

7. A hook element for surface fasteners according to claim 1, wherein each of said grooves has a trapezoidal cross section.

8. A hook element according to claim 1, wherein each of said protuberances has a square cross section.

9. A hook element according to claim 1, wherein each of said grooves has a square cross section.

10. A hook element according to claim 1, wherein each of said grooves has a triangular cross section.

11. A hook element according to claim 1, wherein said hook element has a generally square cross section.

12. A surface fastener comprising:

a substrate in the form of a tape;

a hook element supported on said substrate;

said hook element being made of a thermoplastic monofilamentary material, being thermally set in a hook form and being dyed with a predetermined color, and having a peripheral surface configuration to enhance the retention of a color dye, said surface configuration comprising at least one of protuberances and grooves extending longitudinally throughout the length of said hook element to afford increased surface tension and greater dye pick-up.

13. A hook element for surface fasteners according to claim 12, having a plurality of equally spaced longitudinal protuberances or grooves.

14. A hook element for surface fasteners according to claim 12, having alternate radially extending protuberances and grooves.

15. A hook element for surface fasteners according to claim 12, wherein each of said protuberances has a semicircular cross section.

16. A hook element for surface fasteners according to claim 12, wherein each of said protuberances has a trapezoidal cross section.

17. A hook element for surface fasteners according to claim 12, wherein each of said grooves has a semicircular cross section.

18. A hook element for surface fasteners according to claim 12, wherein each of said grooves has a trapezoidal cross section.

19. A hook element according to claim 12, wherein each of said protuberances has a square cross section.

20. A hook element according to claim 12, wherein each of said grooves has a square cross section.

21. A hook element according to claim 12, wherein each of said grooves has a triangular cross section.

22. A hook element according to claim 12, wherein said hook element has a generally square cross section.

* * * * *